US010252872B2

(12) United States Patent
Nishizawa

(10) Patent No.: US 10,252,872 B2
(45) Date of Patent: Apr. 9, 2019

(54) SHEET CONVEYING APPARATUS THAT FEEDS SHEET MEMBERS, AND DOCUMENT READING APPARATUS AND IMAGE FORMING APPARATUS THAT INCLUDE THE SHEET CONVEYING APPARATUS

(71) Applicant: CANON KABUSHIKI KAISHA, Tokyo (JP)

(72) Inventor: Seiji Nishizawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/492,173

(22) Filed: Apr. 20, 2017

(65) Prior Publication Data

US 2017/0320688 A1 Nov. 9, 2017

(30) Foreign Application Priority Data

May 9, 2016 (JP) ..... 2016-094151
Mar. 7, 2017 (JP) ..... 2017-043068

(51) Int. Cl.
*B65H 3/06* (2006.01)
*B65H 7/02* (2006.01)

(52) U.S. Cl.
CPC ..... *B65H 3/0669* (2013.01); *B65H 7/02* (2013.01); *B65H 2511/212* (2013.01); *B65H 2513/50* (2013.01); *B65H 2515/32* (2013.01); *B65H 2515/704* (2013.01); *B65H 2801/06* (2013.01)

(58) Field of Classification Search
CPC ..... B65H 2511/212; B65H 2515/704; B65H 2220/03; B65H 3/06; B65H 3/0669
See application file for complete search history.

(56) References Cited

U.S. PATENT DOCUMENTS 6,499,734 B1 * 12/2002 Tranquilla ..... B65H 3/0669 271/10.03
2002/0175461 A1 11/2002 Ogasawara
2013/0187329 A1 7/2013 Kato et al.

FOREIGN PATENT DOCUMENTS

JP 2010-202359 A 9/2010
JP 2013-151340 A 8/2013
JP 5262844 B 8/2013

OTHER PUBLICATIONS

Search Report issued in corresponding European Patent Application No. 17166749.6 dated Oct. 12, 2017.

* cited by examiner

*Primary Examiner* — Michael C McCullough
(74) *Attorney, Agent, or Firm* — Venable LLP

(57) ABSTRACT

A sheet conveying apparatus includes: a feeding unit configured to feed a sheet member; a conveying roller that is provided downstream of the feeding unit in a conveying direction, and that is configured to convey the sheet member fed by the feeding unit downstream in the conveying direction; a motor configured to drive the conveying roller. In a state where the conveying roller is conveying a first sheet member that was fed by the feeding unit, if a value of a torque current component of a drive current flowing in a winding of the motor changes from a value greater than or equal to a predetermined value to a value less than the predetermined value, the feeding unit starts feeding of a second sheet member that is to be fed after the first sheet member.

21 Claims, 11 Drawing Sheets

SHEET CONVEYING APPARATUS THAT FEEDS SHEET MEMBERS, AND DOCUMENT READING APPARATUS AND IMAGE FORMING APPARATUS THAT INCLUDE THE SHEET CONVEYING APPARATUS

BACKGROUND OF THE INVENTION

Field of the Invention

The present invention relates to a sheet conveying apparatus, a document reading apparatus and an image forming apparatus.

Description of the Related Art

For example, an image forming apparatus conveys a recording sheet, which is a sheet member stored in a storage unit, and forms an image on the recording sheet. Also, a document reading apparatus conveys a document, which is a sheet member, and reads an image of the document. As one method for increasing the throughput of the image forming apparatus or the document reading apparatus, it is conceivable to shorten the gap between sheet members that are fed. In order to achieve this, it is necessary to advance the feed timing of the trailing sheet member, and the fact that the trailing end of the leading sheet member has passed a predetermined position needs to be detected reliably. For this reason, Japanese Patent No. 5262844 discloses a configuration in which two sensors are provided downstream, in the conveying direction, of a separation unit that separates individual sheet members that are stacked in a stacking unit. According to Japanese Patent No. 5262844, if the two sensors are detecting a sheet member, then either one of the sensors no longer detects a sheet member, and a subsequent sheet member is stacked in the stacking unit, then the operation for feeding the subsequent sheet member is started.

Control for using the two sensors is complicated in the configuration disclosed in Japanese Patent No. 5262844. Also, if two or more sheet members are taken into the separation unit in a partially overlapped state, and the sensors continue to detect the sheet member, a jam will occur.

SUMMARY OF THE INVENTION

According to a first aspect of the present invention, a sheet conveying apparatus includes: a stacking unit configured such that a sheet member is stacked thereon; a feeding unit configured to feed a sheet member stacked on the stacking unit; a conveying roller that is provided downstream of the feeding unit in a conveying direction in which the sheet member is conveyed, and that is configured to convey the sheet member fed by the feeding unit downstream in the conveying direction; a motor configured to drive the conveying roller; a phase determiner configured to determine a rotation phase of a rotor of the motor; and a controller configured to control a drive current flowing in a winding of the motor based on a value of a torque current component for generating torque on the rotor of the motor and a value of an excitation current component that influences an intensity of magnetic flux passing through the winding of the motor, the torque current component and the excitation current component being current components of the drive current flowing in the winding of the motor and being expressed in a rotating coordinate system that is based on the rotation phase determined by the phase determiner, wherein in a state where the conveying roller is conveying a first sheet member that was fed by the feeding unit, if the value of the torque current component of the drive current flowing in the winding of the motor changes from a value greater than or equal to a predetermined value to a value less than the predetermined value, the feeding unit starts feeding of a second sheet member that is to be fed after the first sheet member.

According to a second aspect of the present invention, a document reading apparatus includes: a stacking unit configured such that a document is stacked thereon; a feeding unit configured to feed a document stacked on the stacking unit; a conveying roller that is provided downstream of the feeding unit in a conveying direction in which the document is conveyed, and that is configured to convey the document fed by the feeding unit downstream in the conveying direction; a reading unit configured to read the document conveyed by the conveying roller; a motor configured to drive the conveying roller; a phase determiner configured to determine a rotation phase of a rotor of the motor; and a controller configured to control a drive current flowing in a winding of the motor based on a value of a torque current component for generating torque on the rotor of the motor and a value of an excitation current component that influences an intensity of magnetic flux passing through the winding of the motor, the torque current component and the excitation current component being current components of the drive current flowing in the winding of the motor and being expressed in a rotating coordinate system that is based on the rotation phase determined by the phase determiner. In a state where the conveying roller is conveying a first document that was fed by the feeding unit, if the value of the torque current component of the drive current flowing in the winding of the motor changes from a value greater than or equal to a predetermined value to a value less than the predetermined value, the feeding unit starts feeding of a second document that is to be fed after the first document.

According to a third aspect of the present invention, an image forming apparatus includes: a stacking unit configured such that a sheet member is stacked thereon; a feeding unit configured to feed a sheet member stacked on the stacking unit; a conveying roller that is provided downstream of the feeding unit in a conveying direction in which the sheet member is conveyed, and that is configured to convey the sheet member fed by the feeding unit downstream in the conveying direction; an image forming unit configured to form an image on the sheet member conveyed by the conveying roller; a motor configured to drive the conveying roller; a phase determiner configured to determine a rotation phase of a rotor of the motor; and a controller configured to control a drive current flowing in a winding of the motor based on a value of a torque current component for generating torque on the rotor of the motor and a value of an excitation current component that influences an intensity of magnetic flux passing through the winding of the motor, the torque current component and the excitation current component being current components of the drive current flowing in the winding of the motor and being expressed in a rotating coordinate system that is based on the rotation phase determined by the phase determiner. In a state where the conveying roller is conveying a first sheet member that was fed by the feeding unit, if the value of the torque current component of the drive current flowing in the winding of the motor changes from a value greater than or equal to a predetermined value to a value less than the predetermined value, the feeding unit starts feeding of a second sheet member that is to be fed after the first sheet member.

Further features of the present invention will become apparent from the following description of exemplary embodiments with reference to the attached drawings.

DESCRIPTION OF THE EMBODIMENTS

Hereinafter, illustrative embodiments of the present invention will now be described with reference to the drawings. Note that the following embodiments are illustrative, and the present invention is not intended to be limited to the content of these embodiments. Also, constituent elements that are not necessary to the description of the embodiments are not shown in the figures referenced below.

Figure 1:
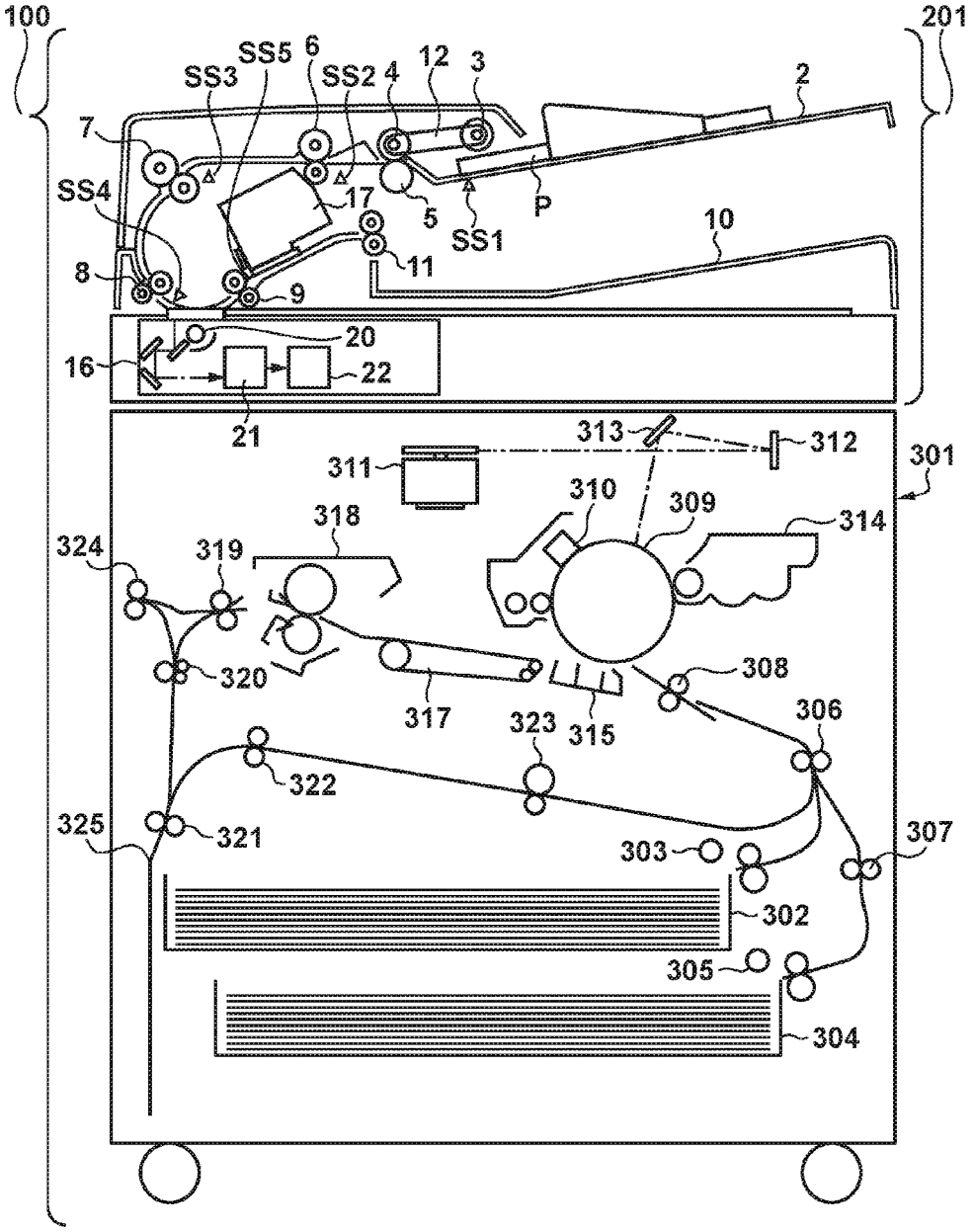
FIG. 1 is a configuration diagram of an image forming apparatus that includes a sheet conveying apparatus according to an embodiment.

FIG. 1 is a configuration diagram of an image forming apparatus 100 according to an embodiment that includes a sheet feeding apparatus that conveys sheet members. The image forming apparatus 100 has a document reading apparatus 201 and an image printing apparatus 301.

The document reading apparatus 201 will be described below. A paper feed tray 2 is a stacking unit on which documents, which are sheet members, are stacked. A pickup roller 3, a conveying roller 4, a separation roller 5, and a rocking arm 12 configure a separation and feeding unit that separates individual documents on the paper feed tray 2 and feeds the documents to a conveying path. The conveying roller 4, the rocking arm 12, and the pickup roller 3 are driven to rotate by a feeding motor M1 that is not shown in FIG. 1. The rocking arm 12 is coupled to the drive shaft of the conveying roller 4 via a torque limiter L1 (not shown). When the feeding motor M1 rotates forward or in reverse, the rocking arm 12 swings via the drive shaft of the conveying roller 4, thus the pickup roller 3 is raised or lowered between a paper feed position for feeding documents stacked on the paper feed tray 2 and a retracted position that is above the paper feed position.

Also, the conveying roller 4 is pressed against the separation roller 5 to form a nip portion. The conveying roller 4 is driven by the feeding motor M1, thus the top document is fed to the conveying path. Here, the separation roller 5 prevents conveying force from being transmitted to a document that is under the document that is to be fed, with use of a torque limiter L2 (not shown). As a result, even if two documents are taken in an overlapped manner, only the top document is fed toward the conveying path.

Also, in FIG. 1, a registration roller 6, a conveying roller 7, reading rollers 8 and 9, and a paper discharge roller 11, which are conveying rollers, configure a conveying unit that conveys a document along the conveying path. The registration roller 6 is provided for correcting skew of a document fed by the separation and feeding unit. Feeding of the document is stopped when the leading end portion of the document runs into the stopped registration roller 6, and then the document is pulled in and conveyed by the registration roller 6. In other words, due to the registration roller 6 rotating while the feeding motor M1 is in the stopped state, the registration roller 6 conveys the document that is nipped in the nip portion of the separation and feeding unit. After skew of the document has been corrected by the registration roller 6, the document is conveyed downstream in the conveying direction by the conveying roller 7 and the reading rollers 8 and 9. And then the document is discharged onto a paper discharge tray 10 by the paper discharge roller 11 after an image of the document has been read.

The document reading apparatus 201 is provided with a document reading unit 16 that reads an image of a first side of a conveyed document. The document is illuminated by an illumination source 20 at a reading position, and reflected light from an image of the document is guided to an image reading unit 21 by an optical system made up of reflecting mirrors, and then converted into an image signal by the image reading unit 21. The image reading unit 21 is configured by a lens, a CCD, which is a photoelectric conversion device, a CCD drive circuit, and the like. The image signal output from the image reading unit 21 is subjected to various types of correction processing by an image processing unit 22 that is configured by a hardware device such as an ASIC, and then output to the image printing apparatus 301 by a control unit 400 that will be described later. The document reading apparatus 201 is also provided with a document reading unit 17 that reads an image of a second side of the conveyed document. The configuration of the document reading unit 17 is similar to the configuration of the document reading unit 16. Image information read by the document reading unit 17 is output to the image printing apparatus 301 using a method similar to the method in the description of the document reading unit 16.

Document reading is performed as described above.

A document set sensor SS1 determines whether or not a document is stacked on the paper feed tray 2. A document detection sensor SS2 detects a document at a position that is downstream of the separation and feeding unit and upstream of the registration roller 6. A conveying sensor SS3 detects a document at a position that is downstream of the registration roller 6 and upstream of the conveying roller 7. A read sensor SS4 and a read sensor SS5 detect a document at positions upstream of the document reading units 16 and 17, respectively. The timing of reading of an image of a document is determined based on detection results from the read sensor SS4 and the read sensor SS5.

Figure 2:
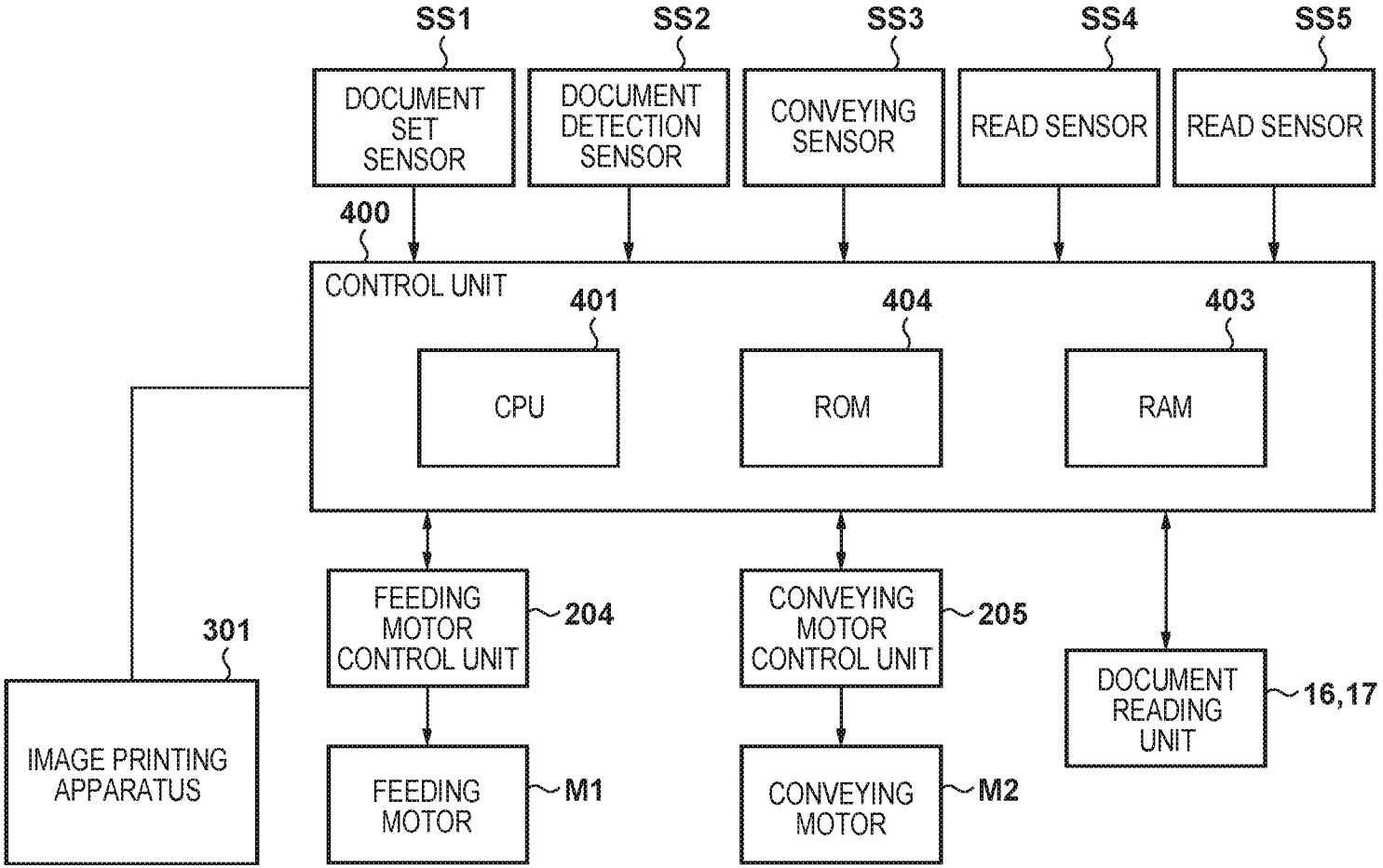
FIG. 2 is a control configuration diagram of a document reading apparatus according to an embodiment.

FIG. 2 is a control configuration diagram of the document reading apparatus 201 according to the present embodiment. A control unit 400 includes a CPU 401, a ROM 404 in which control programs are stored, and a RAM 403 that is used as a region for temporary storage of control data and a work region for calculation involved in control. The control unit 400 can transmit and receive data and commands to and from units connected thereto.

The control unit 400 controls a feeding motor control unit 204 and a conveying motor control unit 205 based on input signals from the sensors described above. The feeding motor control unit 204 controls the feeding motor M1 in accordance with a command output from the control unit 400. As a result, the conveying roller 4 is driven. Also, the conveying motor control unit 205 controls a conveying motor M2 in accordance with a command output from the control unit 400. As a result, rollers of the conveying unit, including the registration roller 6, are driven. By dividing the drive system into two systems in this way, stability is ensured for the speed of the conveying of a document in the conveying unit by the conveying motor M2, even if a sudden load is applied to the feeding motor M1.

As described above, the control unit 400 controls the operation sequence of the document reading apparatus 201. Note that portions of the document reading apparatus 201 other than the document reading units 16 and 17 correspond to a sheet feeding apparatus in the present invention.

Next, the configuration and functions of the image printing apparatus 301 will be described.

Sheet storage trays 302 and 304 are provided inside the image printing apparatus 301. Different types of sheet members can be stored in the sheet storage trays 302 and 304. For example, A4 size normal paper is stored in the sheet storage tray 302, and A4 size heavy paper is stored in the sheet storage tray 304. Note that examples of sheet members include paper, resin sheets, cloth, OHP sheets, and labels, and images are formed on these sheet members.

The sheet members stored in the sheet storage tray 302 are fed by a paper feed roller 303 and then conveyed to registration rollers 308 by conveying rollers 306. Also, the sheet members stored in the sheet storage tray 304 are fed by a paper feed roller 305 and then conveyed to the registration rollers 308 by conveying rollers 307 and 306.

An image signal output from the control unit 400 is received by a light scanning apparatus 311 that includes a semiconductor laser and a polygon mirror. Also, the outer circumferential surface of a photoconductor drum 309 is charged by a charging unit 310. After the outer circumferential surface of the photoconductor drum 309 is charged, laser light corresponding to an image signal input from the control unit 400 to the light scanning apparatus 311 is emitted by the light scanning apparatus 311 onto the outer circumferential surface of the photoconductor drum 309 via the polygon mirror and mirrors 312 and 313. As a result, an electrostatic latent image is formed on the outer circumferential surface of the photoconductor drum 309.

Next, the electrostatic latent image is developed by toner in a developing unit 314, thus forming a toner image on the outer circumferential surface of the photoconductor drum 309. The toner image formed on the photoconductor drum 309 is transferred onto a sheet member by a transfer charging unit 315 that is provided at a position (transfer position) opposing the photoconductor drum 309. At this time, the registration rollers 308 convey the sheet member to the transfer position in accordance with the timing of the toner image.

The sheet member, which has the toner image transferred thereon as described above, is conveyed by a conveying belt 317 to a fixing unit 318, and is heated and pressed by the fixing unit 318 in order to fix the toner image to the sheet member. In this way, an image is formed on a sheet member by the image forming apparatus 100.

When image formation is performed in a single-side print mode, a sheet member that has passed through the fixing unit 318 is discharged to a paper discharge tray (not shown) by paper discharge rollers 319 and 324. Also, when image formation is performed in a double-side print mode, fixing processing is performed on the first side of a sheet member by the fixing unit 318, and then the sheet member is conveyed to an inversion path 325 by the paper discharge rollers 319, conveying rollers 320, and inversion rollers 321. Thereafter, the sheet member is again conveyed to the registration rollers 308 by conveying rollers 322 and 323, and an image is formed on the second side of the sheet member in the manner described above. Thereafter, the sheet member is discharged to a paper discharge tray (not shown) by paper discharge rollers 319 and 324.

Also, when a sheet member with an image formed on the first side is to be discharged from the image forming apparatus 100 in a face-down manner, after passing through the fixing unit 318, the sheet member is conveyed through the paper discharge rollers 319 in a direction toward the conveying rollers 320. Thereafter, immediately before the trailing end of the sheet member passes through the nip portion of the conveying rollers 320, the rotation of the conveying rollers 320 is reversed. As a result, the sheet member passes through the paper discharge rollers 324 and is discharged from the image forming apparatus 100 in the state where the first side of the sheet member faces downward.

Figure 3:
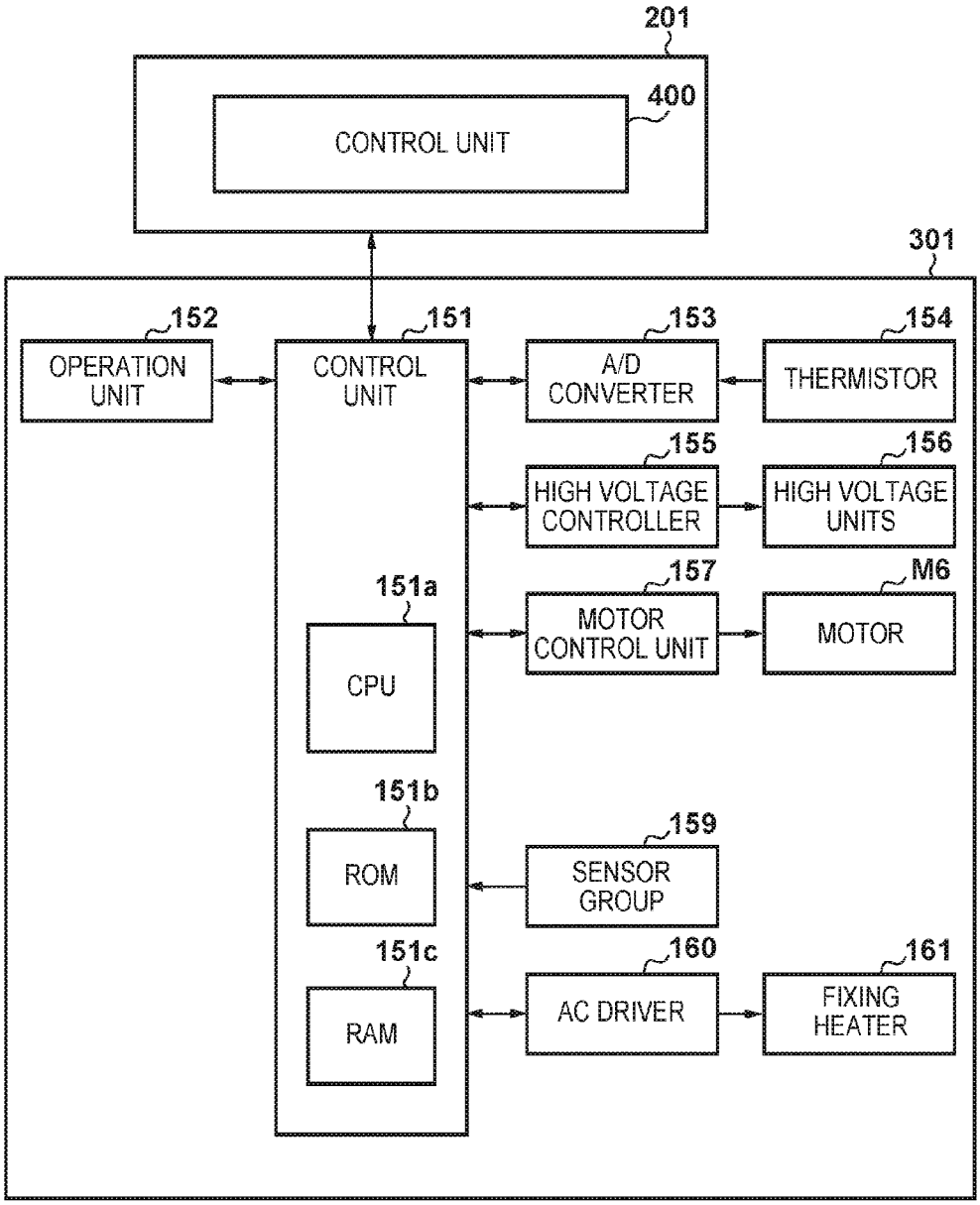
FIG. 3 is a control configuration diagram of an image printing apparatus according to an embodiment.

FIG. 3 is a control configuration diagram of the image printing apparatus 301 according to the present embodiment.

The control unit 151 includes a CPU 151*a*, a ROM 151*b* in which control programs are stored, and a RAM 151*c* that is used as a region for temporary storage of control data and a work region for calculation involved in control. Also, the control unit 151 is connected to the control unit 400, an operation unit 152, an analog-digital (A/D) converter 153, a high voltage control unit 155, a motor control unit 157, a sensor group 159, and an AC driver 160. The control unit 151 can transmit and receive data and commands to and from units connected thereto.

The control unit 151 transmits, to the control unit 400, setting value data for various apparatuses that are provided in the image printing apparatus 301, which is necessary for image processing in the document reading units 16 and 17. The control unit 151 also receives signals from the sensor group 159 and sets setting values for the high voltage control unit 155 based on the received signals. The high voltage control unit 155 supplies necessary voltages to high voltage units 156 (charging unit 310, developing unit 314, transfer charging unit 315, etc.) in accordance with the setting values set by the control unit 151.

The motor control unit 157 controls a motor M6, which drives a load provided in the image printing apparatus 301, by supplying a drive current to the winding of the motor M6 in accordance with a signal output from the CPU 151*a*.

The A/D converter 153 receives a detection signal output from a thermistor 154 which is for detecting the temperature of a fixing heater 161, and converts the detection signal from an analog signal to a digital signal, and transmits the digital signal to the control unit 151. The control unit 151 controls the AC driver 160 based on the digital signal received from the A/D converter 153. The AC driver 160 controls the fixing heater 161 such that the temperature of the fixing heater 161 is a temperature necessary for performing fixing processing.

Note that the fixing heater 161 is a heater used for fixing processing, and is included in the fixing unit 318.

The control unit 151 controls the operation unit 152 such that a display unit provided in the operation unit 152 displays an operation screen used by a user in order to set the type of sheet member that is to be used for image formation, for example. The control unit 151 receives information set by the user from the operation unit 152 and controls the operation sequence of the image printing apparatus 301 based on the information set by the user. The control unit 151 also transmits information indicating the status of the image forming apparatus 100 to the operation unit 152. Note that information indicating the status of the image forming apparatus 100 includes, for example, information regarding the number of printed pages, the progress status of image formation operations, and jamming or overlapping of sheet members in the document reading apparatus 201 and the image printing apparatus 301. The operation unit 152 displays the information received from the control unit 151 on the display unit.

As described above, the control unit 151 controls the operation sequence of the image printing apparatus 301.

Next, the configuration of the conveying motor control unit 205 will be described. The conveying motor control unit 205 of the present embodiment controls the conveying motor M2 using vector control. Note that the motor M2 of the present embodiment is not provided with a sensor such as a rotary encoder for detecting the rotation phase of the rotor of the motor, but it may be configured to be provided with a sensor.

Figure 4:
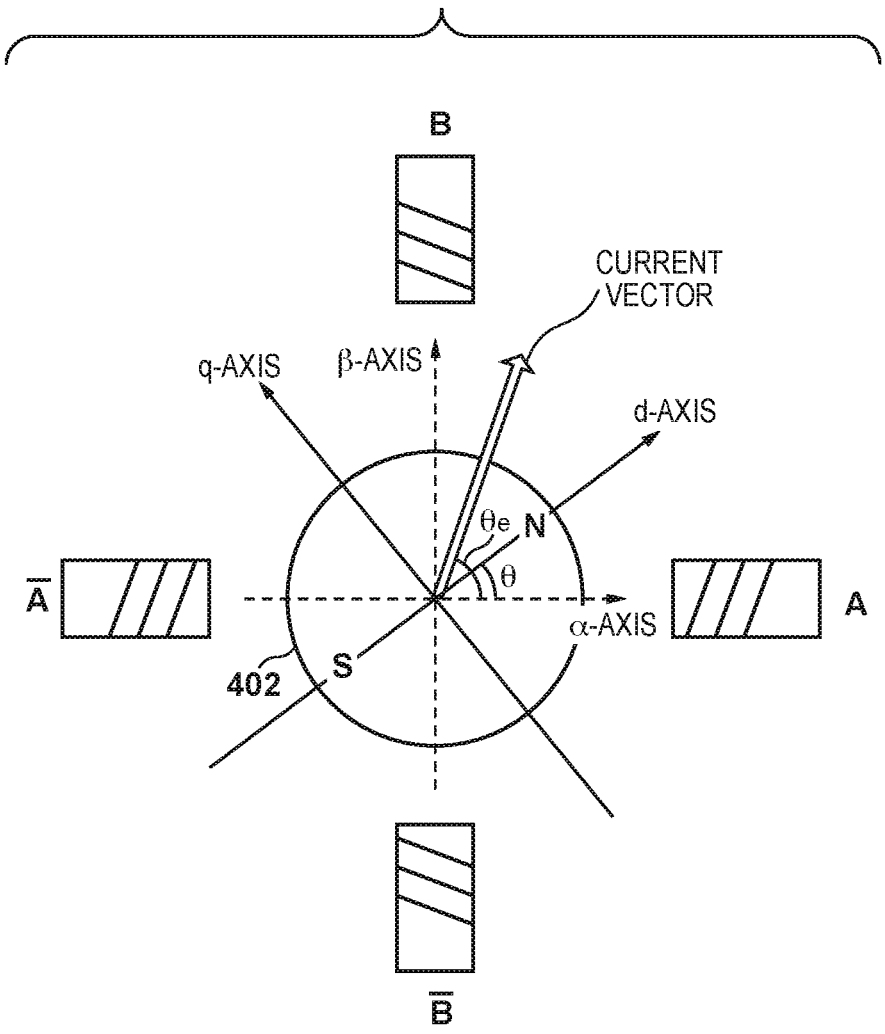
FIG. 4 is a diagram showing the relationship between a two-phase motor, which has an A phase and a B phase, and a d axis and q axis of a rotating coordinate system.

FIG. 4 is a diagram showing the relationship between the conveying motor (simply called the motor hereinafter) M2, which is a two-phase stepping motor that has an A phase (first phase) and a B phase (second phase), and a rotating coordinate system indicated by a d axis and a q axis. In FIG. 4, an a axis that corresponds to the winding in the A phase, and a β axis that corresponds to the winding in the B phase are defined in a static coordinate system. Also, in FIG. 4, the d axis is defined along the direction of magnetic flux produced by the magnetic poles of the permanent magnet used in the rotor 402, and the q axis is defined along a direction advanced 90 degrees in the counter-clockwise direction from the d axis (i.e., along a direction orthogonal to the d axis). The angle formed by the a axis and the d axis is defined as θ, and the rotation phase of the rotor 402 is expressed by this angle θ. A rotating coordinate system based on the rotation phase θ of the rotor 402 is used in vector control. Specifically, vector control uses current components in the rotating coordinate system of the current vector that corresponds to the drive current flowing in the winding, namely the value of the q axis component (torque current component) for generating torque on the rotor and the value of the d axis component (excitation current component) that influences the intensity of the magnetic flux passing through the winding.

Vector control is a control method of controlling a motor by performing phase feedback control for controlling the value of the torque current component and the value of the excitation current component so as to reduce deviation between the actual rotation phase of the rotor of the motor and an instruction phase that indicates the target phase of the rotor of the motor.

Figure 5:
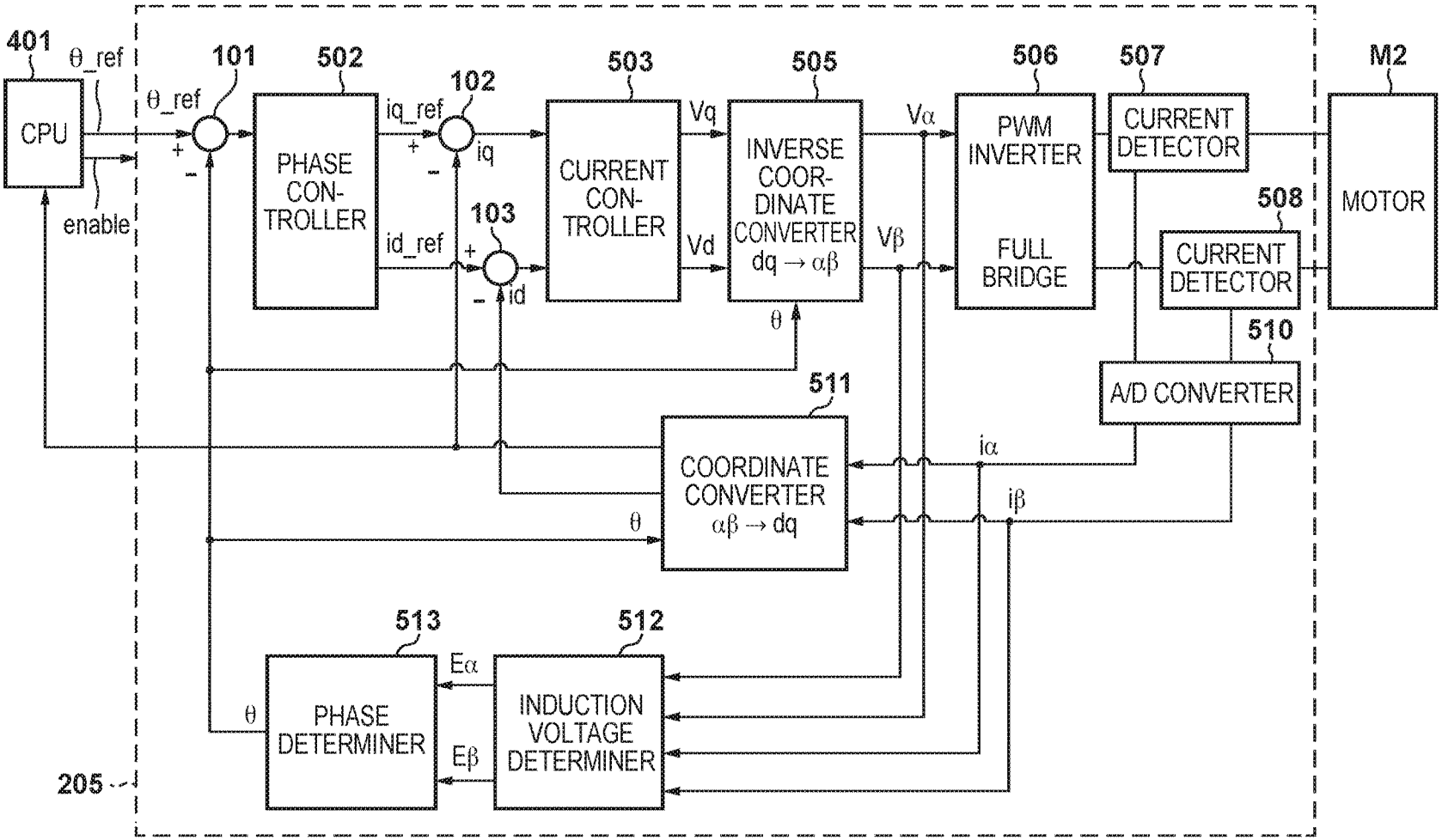
FIG. 5 is a block diagram showing a configuration of a conveying motor control unit according to an embodiment.

FIG. 5 is a block diagram showing an example of the configuration of the conveying motor control unit 205 that controls the motor M2.

As shown in FIG. 5, the conveying motor control unit 205 has a phase controller 502, a current controller 503, an inverse coordinate converter 505, a coordinate converter 511, and a PWM inverter 506 that supplies a drive current to the winding of the motor, as a circuit for performing vector control.

The coordinate converter 511 converts the current vector that corresponds to the drive current flowing in the A phase winding of the motor M2 and B phase winding of the motor M2 from the static coordinate system indicated by the a axis and the β axis to the rotating coordinate system indicated by the q axis and the d axis. As a result, the drive current flowing in the winding is expressed by the current value of the q axis component (q axis current) and the current value of the d axis component (d axis current), which are current values in the rotating coordinate system. Note that the q axis current corresponds to the torque current for generating torque on the rotor 402 of the motor M2. Also, the d axis current corresponds to the excitation current that influences the intensity of the magnetic flux that passes through the winding of the motor M2, and does not contribute to generating torque on the rotor 402. The conveying motor control unit 205 can control the q axis current and the d axis current independently. As a result, by controlling the q axis current in accordance with the load torque applied to the rotor, the conveying motor control unit 205 can efficiently generate the torque needed to cause the rotor 402 to rotate.

The conveying motor control unit 205 determines the rotation phase θ of the rotor 402 of the motor M2 using a method described later, and performs vector control based on the determination result. The CPU 401 generates an instruction phase θ_ref that indicates a target phase for the rotor 402 of the motor M2, and outputs the instruction phase θ_ref to the conveying motor control unit 205 at a predetermined time cycle.

A subtractor 101 calculates the deviation between the rotation phase θ of the rotor 402 of the motor M2 and the instruction phase θ_ref, and outputs the deviation to the phase controller 502.

Based on proportional control (P), integral control (I), and differential control (D), the phase controller 502 generates and outputs a q axis current instruction value iq_ref and a d axis current instruction value id_ref such that the deviation output by the subtractor 101 decreases. Specifically, based on P control, I control, and D control, the phase controller 502 generates and outputs the q axis current instruction value iq_ref and the d axis current instruction value id_ref such that the deviation output by the subtractor 101 decreases to 0. Note that P control is a control method of controlling a target value based on a value that is proportional to the deviation between an instruction value and an estimated value. Also, I control is a control method of controlling a target value based on a value that is proportional to the time integration of the deviation between an instruction value and an estimated value. Also, D control is a control method of controlling a target value based on a value that is proportional to the time variation of the deviation between an instruction value and an estimated value. The phase controller 502 of the present embodiment generates the q axis current instruction value iq_ref and the d axis current instruction value id_ref based on PID control, but the present invention is not limited to this configuration. For example, the phase controller 502 may generate the q axis current instruction value iq_ref and the d axis current instruction value id_ref based on PI control. Note that if a permanent magnet is used in the rotor 402, the d axis current instruction value id_ref that influences the intensity of the magnetic flux that passes through the winding is normally set to 0, but the present invention is not limited to this configuration.

The drive current that flows in the A phase winding of the motor M2 and the B phase winding of the motor M2 is detected by current detectors 507 and 508, and is then converted from an analog value to a digital value by an A/D converter 510.

The current value of the drive current obtained by conversion from an analog value to a digital value by the A/D converter 510 is expressed as current values iα and iβ in the static coordinate system by the following expressions using a phase θe of the current vector shown in FIG. 4. Note that the phase θe of the current vector is defined as the angle formed by the α axis and the current vector. Also, I indicates the magnitude of the current vector.

$$i\alpha = I^* \cos \theta e \quad (1)$$

$$i\beta = I^* \sin \theta e \quad (2)$$

These current values iα and iβ are input to the coordinate converter 511 and an induced voltage determiner 512.

Using the following expressions, the coordinate converter 511 converts the current values iα and iβ into a current value iq for the q axis current and a current value id for the d axis current in the rotating coordinate system.

$$id = \cos \theta^* i\alpha + \sin \theta^* i\beta \quad (3)$$

$$iq = -\sin \theta^* i\alpha + \cos \theta^* i\beta \quad (4)$$

The converted current value iq obtained by the coordinate converter 511 is input to a subtractor 102 and the CPU 401. Also, the converted current value id obtained by the coordinate converter 511 is input to a subtractor 103.

The subtractor 102 calculates the deviation between the q axis current instruction value iq_ref output from the phase controller 502 and the current value iq output from the coordinate converter 511, and outputs the deviation to the current controller 503.

Also, the subtractor 103 calculates the deviation between the d axis current instruction value id_ref output from the phase controller 502 and the current value id output from the coordinate converter 511, and outputs the deviation to the current controller 503.

Based on PID control, the current controller 503 generates drive voltages Vq and Vd such that the deviations decrease. Specifically, the current controller 503 generates the drive voltages Vq and Vd such that the deviations decrease to 0, and outputs these drive voltages to the inverse coordinate converter 505. Note that although the current controller 503 of the present embodiment generates the drive voltages Vq and Vd based on PID control, the present invention is not limited to this configuration. For example, the current controller 503 may generate the drive voltages Vq and Vd based on PI control.

The inverse coordinate converter 505 uses the following expressions to convert the drive voltages Vq and Vd in the rotating coordinate system that were output from the current controller 503 to drive voltages Va and Vβ in the static coordinate system.

$$V\alpha = \cos \theta^* Vd - \sin \theta^* Vq \quad (5)$$

$$V\alpha = \sin \theta^* Vd + \cos \theta^* Vq \quad (6)$$

The inverse coordinate converter 505 converts the drive voltages Vq and Vd in the rotating coordinate system into the drive voltages Vα and Vβ in the static coordinate system, and then outputs the drive voltages Vα and Vβ to the PWM inverter 506 and the induced voltage determiner 512.

The PWM inverter 506 has a full bridge circuit. The full bridge circuit is driven by a PWM signal that is based on the drive voltages Vα and Vβ received from the inverse coordinate converter 505. As a result, the PWM inverter 506 generates drive currents iα and iβ that correspond to the drive voltages Vα and Vβ, and drives the motor M2 by supplying the drive currents iα and iβ to the winding of the motor M2 in the respective phases. Note that although the PWM inverter of the present embodiment has a full bridge circuit, the PWM inverter may have a half bridge circuit or the like.

Next, a method of determining the rotation phase θ of the rotor will be described. In case where the rotation phase θ of the rotor is determined, induced voltages Eα and Eβ that are induced in the A phase winding of the motor M2 and B phase winding of the motor M2 by rotation of the rotor are used. The induced voltage values are determined (calculated) by the induced voltage determiner 512. Specifically, the induced voltages Eα and Eβ are determined by the followings expressions, based on the current values iα and iβ that were input to the induced voltage determiner 512 from the A/D converter 510 and the drive voltages Vα and Vβ that were input to the induced voltage determiner 512 from the inverse coordinate converter 505.

$$E\alpha = V\alpha - R^* i\alpha - L^* di\alpha/dt \quad (7)$$

$$E\beta = V\beta - R^* i\beta - L^* di\beta/dt \quad (8)$$

Here, R is the winding resistance, and L is the winding inductance. The values of the winding resistance R and the winding inductance L are values unique to the motor M2 that is being used, and are stored in advance in the ROM 404 or a memory (not shown) provided in the conveying motor control unit 205.

The induced voltages Eα and Eβ determined by the induced voltage determiner 512 are output to a phase determiner 513.

The phase determiner 513 uses the following expression to determine the rotation phase θ of the rotor 402 of the motor M2, based on the ratio of the induced voltage Eα and the induced voltage Eβ that were output from the induced voltage determiner 512.

$$\theta = \tan^{-1}(-E\beta/E\alpha) \quad (9)$$

Note that although the phase determiner 513 of the present embodiment determines the rotation phase θ by performing calculation based on Expression (9), the present invention is not limited to this configuration. For example, the phase determiner 513 may determine the rotation phase θ by reference to a table that is stored in the ROM 151*b* or the like and indicates the relationship between the induced voltages Eα and Eβ and the rotation phase θ corresponding to the induced voltages Eα and Eβ.

The rotation phase θ of the rotor obtained as described above is input to the subtractor 101, the inverse coordinate converter 505, and the coordinate converter 511.

The conveying motor control unit 205 repeatedly performs the above-described control.

As described above, the conveying motor control unit 205 of the present embodiment performs vector control using phase feedback control for controlling current values in the rotating coordinate system so as to reduce deviation between the instruction phase θ_ref and the rotation phase θ. Performing vector control makes it possible to suppress situations where the motor enters a step-out state, or motor noise and power consumption increase due to excessive torque.

Figure 6:
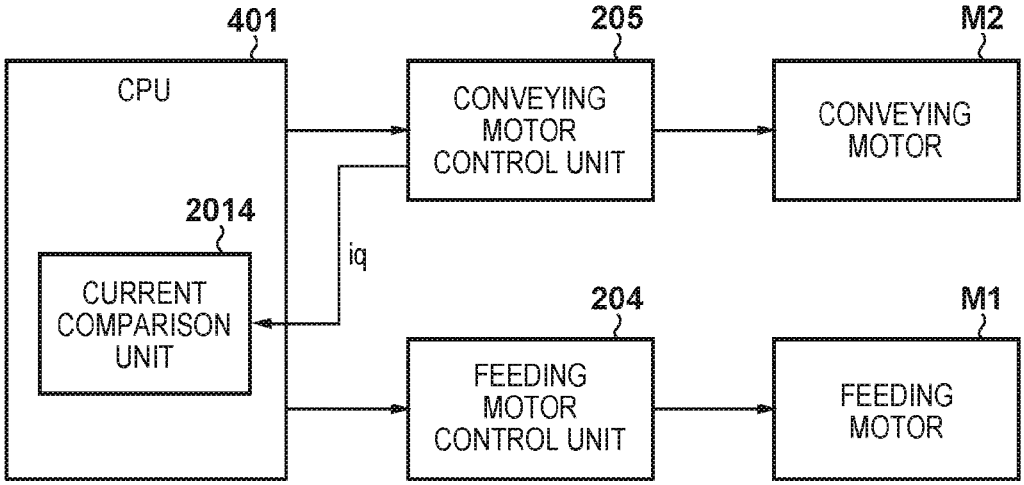
FIG. 6 is a function block diagram of a CPU according to an embodiment.

FIG. 6 is a functional block diagram related to feeding control and conveying control performed by the CPU 401. As shown in FIG. 6, the current value iq output from the conveying motor control unit 205 is input to a current comparison unit 2014 provided in the CPU 401. The current comparison unit 2014 detects variation in the current value iq and controls the feeding motor control unit 204 based on the detection result.

The feeding motor control unit 204 drives the feed motor M1 as described below.

Figure 7A:
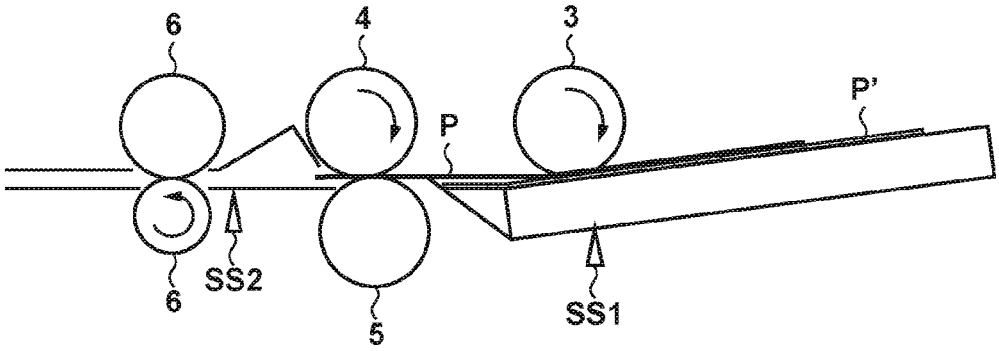
FIGS. 7A to 7C are diagrams illustrating feeding control according to an embodiment.
Figure 7B:
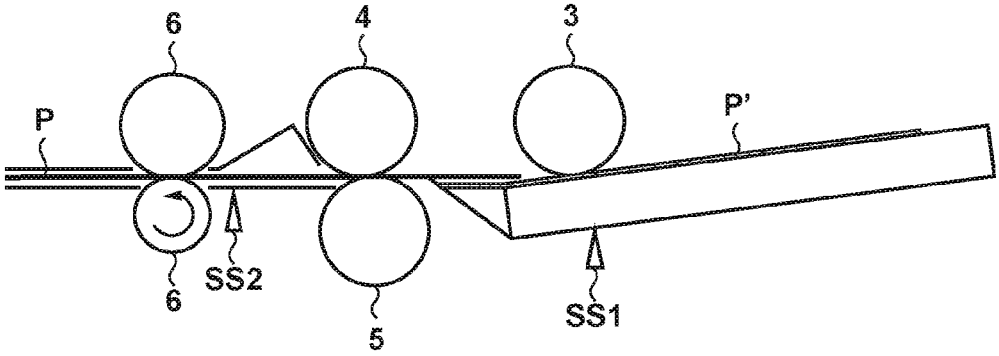
Figure 7C:
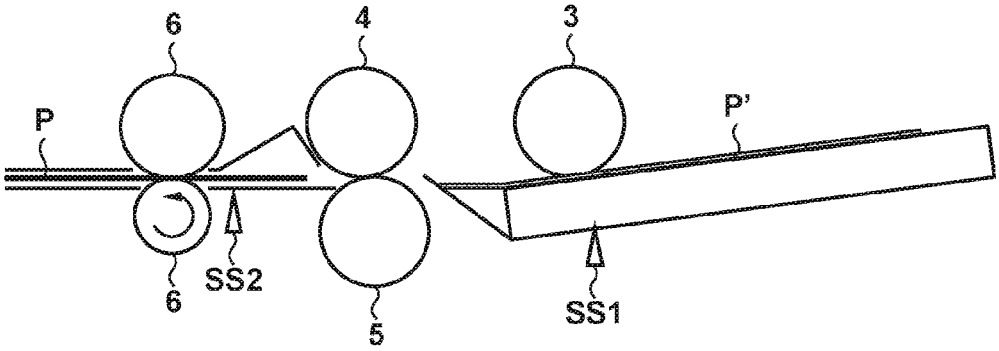

The following describes an example of document feeding and conveying with reference to FIGS. 7A to 7C. Note that in the following, the document targeted for feeding and conveying is called the document P, and the document that is to be fed and conveyed after the document P is called the document P'.

FIG. 7A shows the state where the document P is fed by the pickup roller 3, and the leading end has arrived at the nip portion of the separation and feeding unit. The separation roller 5 comes into contact with the document P and rotates due to the force of friction with the document P. Note that in FIG. 7A, the leading end of the document P' has not arrived at the nip portion of the separation and feeding unit.

FIG. 7B shows the state where the document P is being conveyed by rotation of the registration roller 6. When the document P is conveyed by the registration roller 6, driving of the feeding motor M1 is stopped. As a result, rotation of the pickup roller 3 and the conveying roller 4 stops. In FIG. 7B, the document P is in contact with the conveying roller 4 and the separation roller 5, and therefore the conveying roller 4 and the separation roller 5 rotate due to the force of friction with the document P. In other words, while the document P is being conveyed by the registration roller 6, the conveying roller 4 and the separation roller 5 rotate due to the force of friction with the document P. Note that in FIG. 7B, the leading end of the trailing document P' has not arrived at the nip portion of the separation and feeding unit.

FIG. 7C shows the state where the trailing end of the document P being conveyed by the registration roller 6 has exited the nip portion of the separation and feeding unit. The conveying roller 4 and the separation roller 5 stop rotating due to no longer being in contact with the document P. Note that in FIG. 7C, the leading end of the document P' has not arrived at the nip portion of the separation and feeding unit.

Figure 8A:
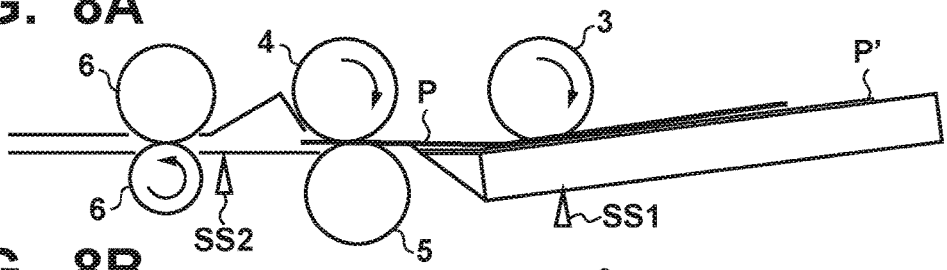
FIGS. 8A to 8F are diagrams illustrating feeding control according to an embodiment.
Figure 8B:
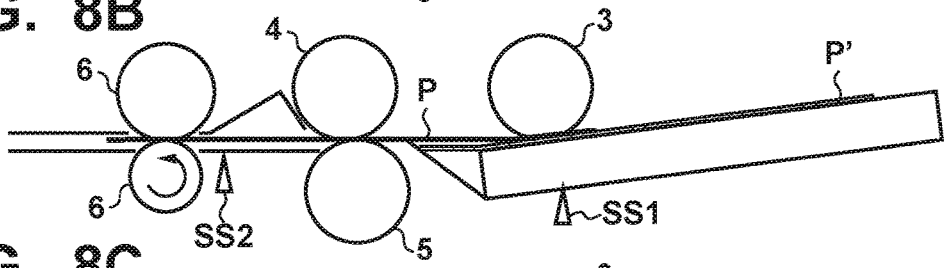

The following describes another example of document feeding and conveying with reference to FIGS. 8A to 8F. FIGS. 8A and 8B are similar to FIGS. 7A and 7B.

Figure 8C:
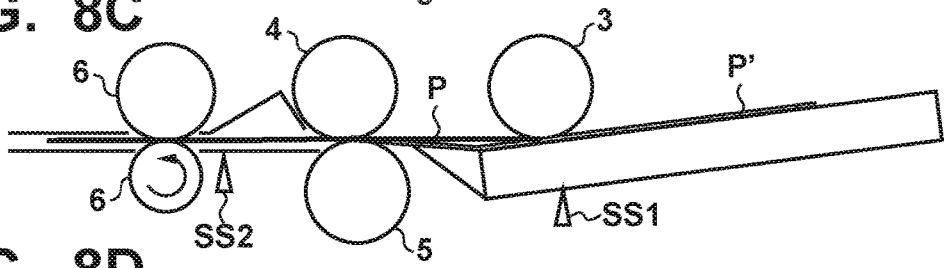

FIG. 8C shows the state where the document P is in the same state as in FIG. 8B, but the leading end of the document P' has just arrived at the nip portion of the separation and feeding unit. Due to the document P' entering the space between the document P and the separation roller 5, the force of friction with the document P is not directly transmitted to the separation roller 5. Accordingly, rotation of the separation roller 5 stops.

Figure 8D:
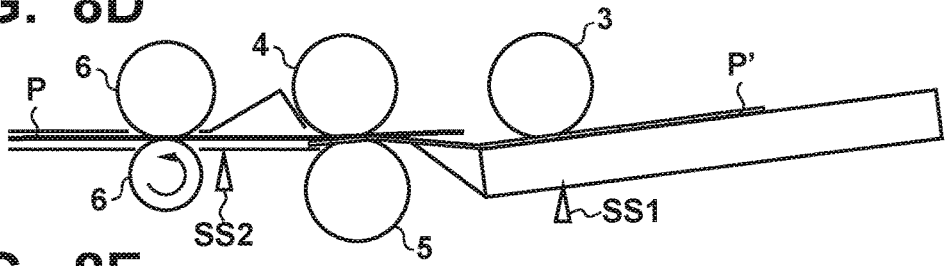
Figure 8E:
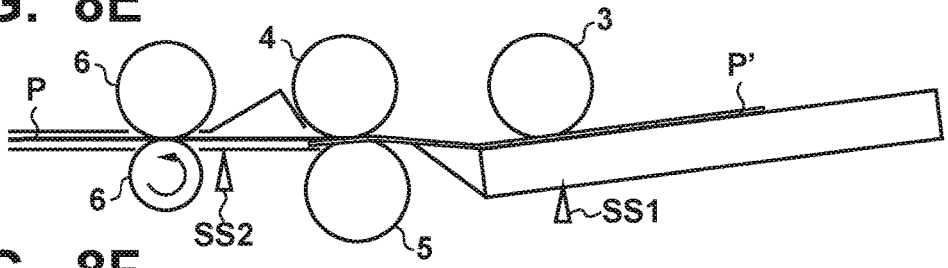
Figure 8F:
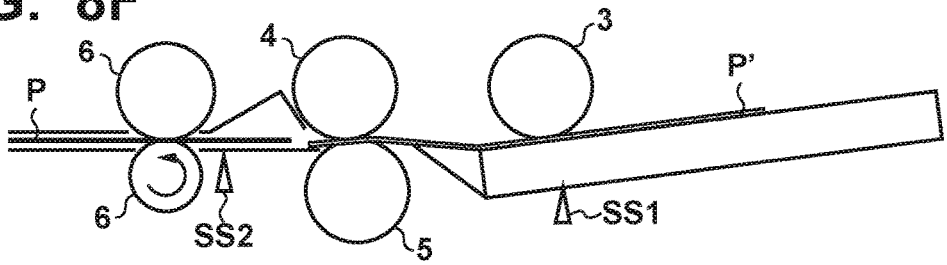

FIG. 8D shows the state where the document P' has moved downstream a little from the state in FIG. 8C due to frictional force between the document P and the document P'. FIG. 8E shows the state immediately after the document P has been conveyed by the registration roller 6 and the trailing end has exited the nip portion of the separation and feeding unit, and FIG. 8F shows the state where the document P has been conveyed downstream a little from the state in FIG. 8E.

The following describes change in the torque applied to the rotor of the conveying motor M2 that drives the registration roller 6.

In the states shown in FIGS. 7B and 8B, frictional force generated by friction between the document P and the conveying roller 4 and frictional force generated by friction between the document P and the separation roller 5 act on the leading document P in the direction opposite to the conveying direction. In other words, the torque applied to the rotor of the conveying motor M2 that drives the registration roller 6 is the result of the torque corresponding to the frictional force acting on the document P in the direction opposite to the conveying direction being added to the torque corresponding to the frictional force generated by friction between the registration roller 6 and the document P. Hereinafter, "state #1" refers to the state where due to the rotation of the registration roller 6, the document P is conveyed, and the conveying roller 4 and the separation roller 5 rotate due to the force of friction with the document P. Also, "first torque" refers to the torque applied to the rotor of the conveying motor M2 that drives the registration roller 6 in state #1.

On the other hand, in the state shown in FIG. 7C, the leading document P is conveyed by the registration roller 6, but the rotation of the conveying roller 4 and the separation roller 5 is stopped because the trailing end of the document P has exited the nip portion of the separation and feeding unit. At this time, the torque applied to the rotor of the conveying motor M2 that drives the registration roller 6 is the torque corresponding to the frictional force generated by friction between the registration roller 6 and the document P. Hereinafter, "state #2" refers to the state where due to the rotation of the registration roller 6, the document P is conveyed, and the conveying roller 4 and the separation roller 5 are not rotating. Also, "second torque" refers to the torque applied to the rotor of the conveying motor M2 that drives the registration roller 6 in state #2.

Also, in the state shown in FIG. 8D, frictional force generated by friction between the document P and the conveying roller 4 and frictional force generated by friction between the document P and the document P' act on the leading document P in the direction opposite to the conveying direction. Note that the separation roller 5 has stopped rotating because the leading end of the trailing document P' has entered the nip portion of the separation and feeding unit. At this time, the torque applied to the rotor of the conveying motor M2 that drives the registration roller 6 is the result of the torque corresponding to the frictional force acting on the document P in the direction opposite to the conveying direction being added to the torque corresponding to the frictional force generated by friction between the registration roller 6 and the document P. Hereinafter, "state #3" refers to the state where due to the rotation of the registration roller 6, the document P is conveyed, and the separation roller 5 is not rotating because the leading end of the trailing document P' has entered the nip portion of the separation and feeding unit. Also, "third torque" refers to the torque applied to the rotor of the conveying motor M2 that drives the registration roller 6 in state #3. Note that the frictional force generated by friction between the document P and the document P' is smaller than the frictional force generated by friction between the document P and the separation roller 5. Accordingly, the third torque is smaller than the first torque.

According to the above description, out of the first torque, the second torque, and the third torque, the first torque has the highest value, the second torque has the lowest value, and the third torque has a value between the first torque and the second torque.

Note that the state shown in FIG. 8F is the state where the trailing end of the document P has exited the nip portion of the separation and feeding unit. The torque applied at this time to the rotor of the conveying motor M2 that drives the registration roller 6 is similar to the second torque in FIG. 7C. However, the state shown in FIG. 8F is the state after shifting from state #3, and the document P' is nipped in the nip portion of the separation and feeding unit. Hereinafter, "state #4" refers to the state shown in FIG. 8F in which the trailing end of the document P has exited the nip portion of the separation and feeding unit, and the document P is not overlapped with the document P' nipped in the nip portion of the separation and feeding unit.

The current comparison unit 2014 of the present embodiment determines which of the states #1 to #4 the document P and the document P' are in based on the current value iq acquired from the conveying motor control unit 205. The following describes a method by which the current comparison unit 2014 determines the states of the document P and the document P' based on the current value iq. Note that in the following description, a value that is less than the value of the torque current component corresponding to the first torque and is greater than the value of the torque current component corresponding to the third torque is set as a first threshold value ith1. Also, a value that is less than the value of the torque current component corresponding to the third torque and is greater than the value of the torque current component corresponding to the second torque is set as a second threshold value ith2. Note that the second threshold value ith2 is set to a value according to which the current value iq does not fall below the second threshold value ith2 in the case where the document P is being conveyed while the trailing document P' and the document P are overlapped.

Figure 9:
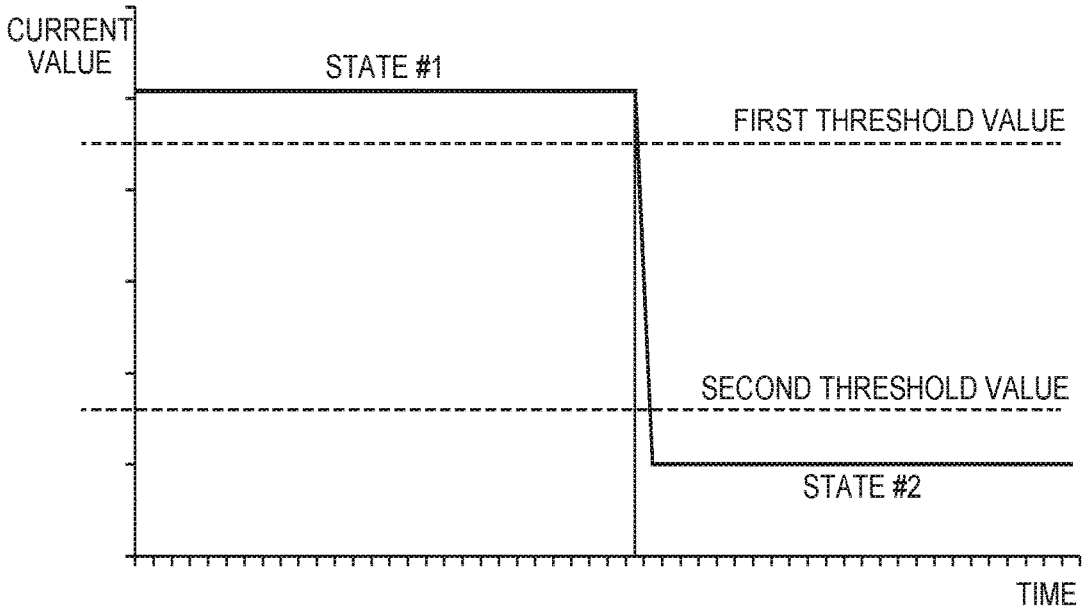
FIG. 9 is a diagram illustrating state determination according to an embodiment.
Figure 10:
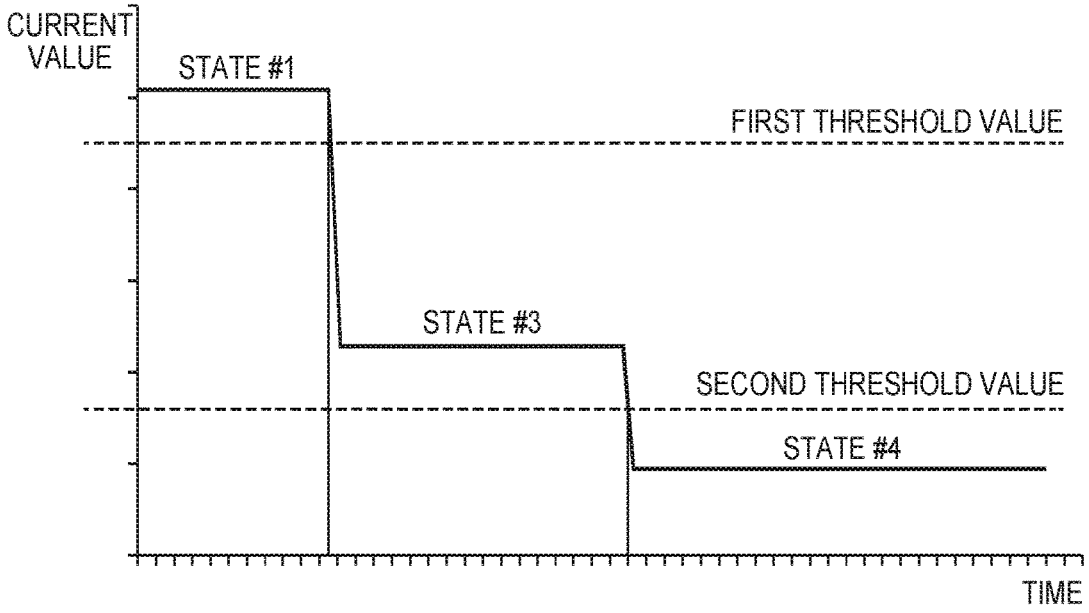
FIG. 10 is a diagram illustrating state determination according to an embodiment.

FIGS. 9 and 10 are diagrams showing the relationship between the current value iq, the first threshold value ith1, and the second threshold value ith2. As shown in FIG. 9, if the received current value iq is greater than or equal to the first threshold value ith1, the current comparison unit 2014 determines that the document P and the document P' are in state #1. Thereafter, if the received current value iq shifts to the state of being a value that is less than the second threshold value ith2 before the state where the received current value iq is less than the first threshold value ith1 and greater than or equal to the second threshold value ith2 continues for a predetermined time T1, the current comparison unit 2014 determines that the document P and the document P' have shifted from state #1 to state #2.

On the other hand, as shown in FIG. 10, after it is determined that the state is state #1, if the state where the received current value iq is less than the first threshold value ith1 and greater than or equal to the second threshold value ith2 has continued for the predetermined time T1, the current comparison unit 2014 determines that the document P and the document P' have shifted from state #1 to state #3. Thereafter, if the received current value iq falls to a value less than the second threshold value ith2, the current comparison unit 2014 determines that the document P and the document P' have shifted from state #3 to state #4. Note that the predetermined time T1 is set to a time that is longer than the time required for the document P and the document P' to shift from state #1 to state #2 in FIG. 9, and that is shorter than the time for which the state that the document P and the document P' are in the state #3 in FIG. 10 continues.

Figure 11:
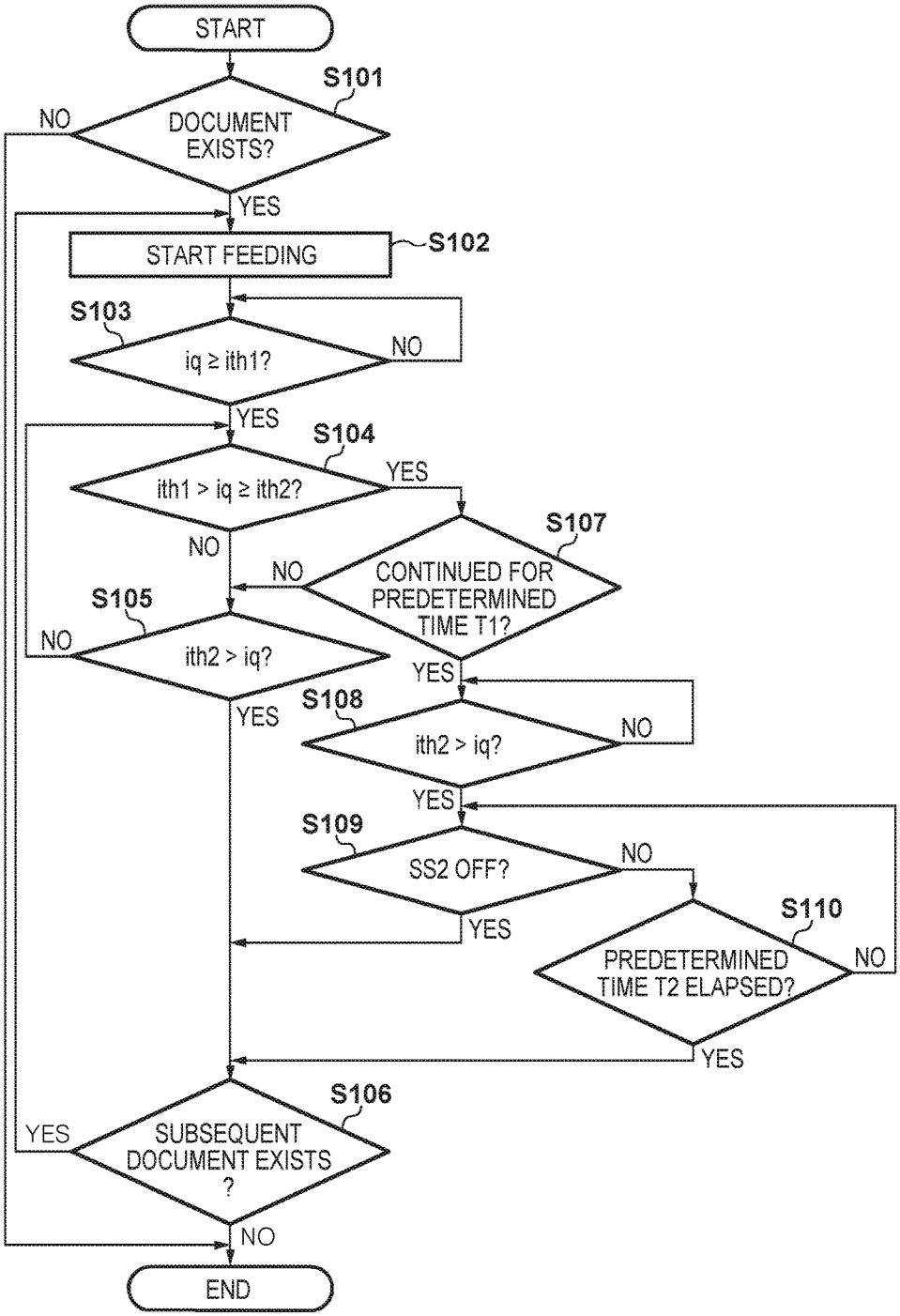
FIG. 11 is a flowchart of feeding control according to an embodiment.

FIG. 11 is a flowchart of feeding control in the image forming apparatus 100. The processing of this flowchart is executed by the CPU 401.

After a sheet conveying instruction is received, in step S101, the CPU 401 determines whether or not a document is stacked (exists) on the paper feed tray 2 based on output from the document set sensor SS1. If a document is not stacked on the paper feed tray 2, the CPU 401 ends the processing of this flowchart. On the other hand, if a document is stacked on the paper feed tray 2, the CPU 401 starts document feeding and document conveying by the conveying motors M1 and M2 in step S102.

Next, in step S103, if the current value iq is greater than or equal to the first threshold value ith1, the CPU 401 moves to the processing of step S104.

Thereafter, in step S104, if the current value iq is not a value that is less than the first threshold value ith1 and greater than or equal to the second threshold value ith2, the CPU 401 moves to the processing of step S105.

In step S105, if the current value iq is not less than the second threshold value ith2, the CPU 401 repeats processing from step S104.

In step S105, if the current value iq is less than the second threshold value ith2, the CPU 401 moves to the processing of step S106.

In step S106, it is determined whether or not a subsequent document is stacked on the paper feed tray 2 based on output from the document set sensor SS1. If a subsequent document is not stacked on the paper feed tray 2, the CPU 401 ends the processing of this flowchart. On the other hand, if a subsequent document is stacked on the paper feed tray 2, the CPU 401 repeats processing from step S102.

In step S104, if the current value iq is less than the first threshold value ith1 and greater than or equal to the second threshold value ith2, the CPU 401 moves to the processing of step S107.

In step S107, if the state where the current value iq is less than the first threshold value ith1 and greater than or equal to the second threshold value ith2 has not continued for the predetermined time T1, the CPU 401 moves to the processing of step S105.

Also, in step S107, if the state where the current value iq is less than the first threshold value ith1 and greater than or equal to the second threshold value ith2 has continued for the predetermined time T1, the CPU 401 moves to the processing of step S108.

Thereafter, if it is determined in step S108 that the current value iq has fallen to a value less than the second threshold value ith2, the procedure moves to step S109, in which the CPU 401 determines whether the document detection sensor SS2 is OFF, that is to say whether the document detection sensor SS2 has not detected a document. Note that if the document detection sensor SS2 has not detected a document in step S109, this means that the trailing end of the document P that is to be fed is downstream of the document detection sensor SS2 in the conveying direction, and the leading end of the subsequent document P' is upstream of the document detection sensor SS2 in the conveying direction. In other words, this means that a gap exists between the document P that is to be fed and the subsequent document P'.

If the document detection sensor SS2 has not detected a document in step S109, the CPU 401 determines in step S106 whether a subsequent document exists, and starts the feeding of the subsequent document in step S102 if it exists. Note that the subsequent document in this case is the document that is nipped in the nip portion of the separation and feeding unit.

On the other hand, if the document detection sensor SS2 has detected a document in step S109, the CPU 401 moves to the processing of step S110.

In step S110, if the predetermined time T2 has not elapsed since when the current value iq fell below the second threshold value ith2, the CPU 401 repeats processing from step S109. Note that if the predetermined time T2 has elapsed in step S110, this means that the subsequent document P' has been detected by the document detection sensor SS2. Also, the current value iq is less than the second threshold value ith2, and therefore there is no overlap of the leading document P and the subsequent document P'. Accordingly, if the predetermined time T2 has elapsed in step S110, and the subsequent document exists in step S106, the CPU 401 starts the feeding of the subsequent document. Note that the subsequent document referred to here is the document P' that is nipped in the nip portion of the separation and feeding unit and has been detected by the document detection sensor SS2.

When a sheet conveying instruction is received, the CPU 401 performs the above processing repeatedly.

As described above, in the present embodiment, sheet member feeding is controlled based on the current value iq.

Specifically, if the current value iq is greater than or equal to the first threshold value ith1, and then falls to a value less than the second threshold value ith2 without the state of being less than the first threshold value ith1 and greater than or equal to the second threshold value ith2 continuing for the predetermined time T1, the CPU 401 determines that the trailing end of the document P has passed through the separation and feeding unit. In this case, if the subsequent document P' exists, the CPU 401 starts the feeding of the subsequent document P'.

On the other hand, if the current value iq is greater than or equal to the first threshold value ith1, and then the state of being less than the first threshold value ith1 and greater than or equal to the second threshold value ith2 continues for the predetermined time T1, the CPU 401 determines that the document P that is to be fed and the subsequent document P' are nipped in the nip portion of the separation and feeding unit. Note that the document P that is to be fed is being conveyed by the registration roller 6. Thereafter, if the current value iq falls below the second threshold value ith2, the CPU 401 determines that there is no overlap between the document P that is to be fed and the subsequent document P', and that the trailing end of the document P that is to be fed has passed through the nip portion of the separation and feeding unit. Note that it can be determined that overlap has disappeared because the current value iq does not fall below the second threshold value ith2 if the subsequent document P' is moving due to the force of friction with the document P that is to be fed.

In this case, when the document detection sensor SS2 no longer detects the document P, the CPU 401 starts the feeding of the subsequent document P'. This is because if the document detection sensor SS2 has not detected a document, this means that the trailing end of the document P that is to be fed is downstream of the document detection sensor SS2 in the conveying direction, and the leading end of the subsequent document P' is upstream of the document detection sensor SS2 in the conveying direction. Also, if the predetermined time T2 has elapsed since when the current value iq fell below the second threshold value ith2, the CPU 401 starts the feeding of the subsequent document P'. Due to waiting for the predetermined time T2, it is possible to ensure a gap between the document P that is to be fed and the subsequent document P'. As a result, it is possible to suppress jamming even if the feeding of the subsequent document P' is started.

In this way, in the present embodiment, the exit of the document that is to be fed from the separation and feeding unit is determined based on the value of the torque current component. Also, overlapped feeding of the document P that is to be fed and the subsequent document P' in the nip portion of the separation and feeding unit, and the disappearance of this overlapped state are detected based on the value of the torque current component. By detecting the disappearance of this overlapped state, the feeding timing of the subsequent document P' is appropriately determined. In this way, the configuration of the present embodiment makes it possible to shorten the gap between sheet members that are fed and conveyed.

Note that although feeding control is performed based on the current value iq in the present embodiment, the present invention is not limited to this configuration. For example, feeding control may be performed based on the q axis current instruction value iq_ref.

Also, feeding control may be performed based on a load torque T applied to the rotor of the motor M2. Note that the load torque T is determined based on deviation between the rotation phase θ of the rotor 402 and the instruction phase θ_ref, for example. Also, the load torque T may be determined based on a table that is stored in the ROM 404 in advance and shows the relationship between the current value iq and the load torque T.

Also, although the separation roller 5 is used as the separation unit for separating fed sheet members in the present embodiment, the present invention is not limited to this configuration. A separation pad or the like may be used.

Also, although a stepping motor is used as the motor for driving the load in the present embodiment, another motor such as a DC motor may be used. Also, the motor is not limited to being a two-phase motor, and may be another motor such as a three-phase motor.

Figure 12:
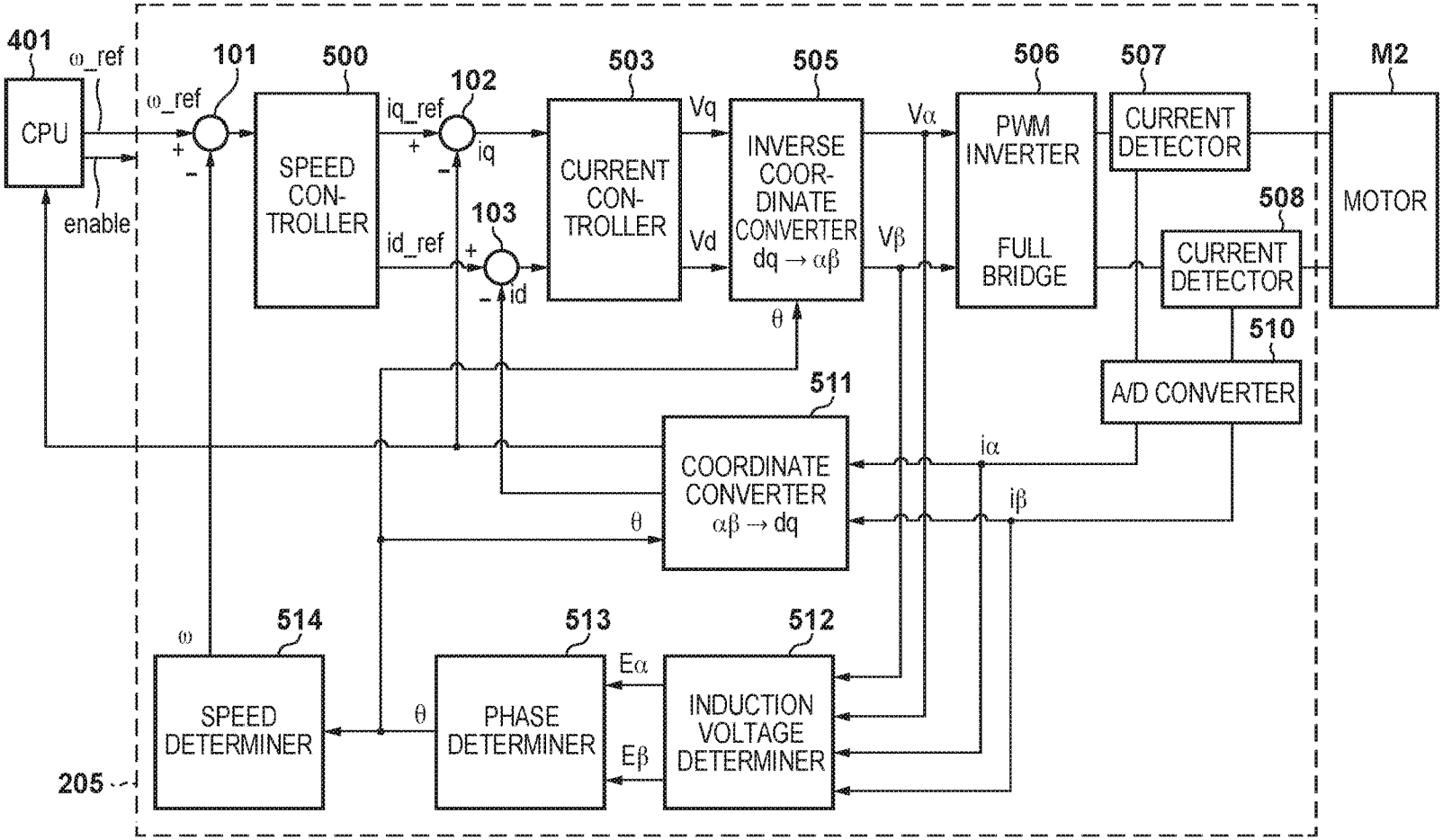
FIG. 12 is a block diagram showing a configuration of a conveying motor control unit according to another embodiment.

Also, although the conveying motor control unit controls the motor M2 by performing phase feedback control in the present embodiment, the present invention is not limited to this configuration. For example, the conveying motor control unit may be configured to control the motor M2 by feedback of a rotation speed ω of the rotor 402. Specifically, in this case, as shown in FIG. 12, a speed controller 500 provided in the conveying motor control unit generates and outputs a q axis current instruction value iq_ref and a d axis current instruction value id_ref so as to reduce deviation between the rotation speed ω and a command speed ω_ref that is output from the CPU 401 and indicates a target speed for the rotor. The motor M2 may be controlled by performing this speed feedback control. Note that the rotation speed ω is determined by a speed determiner 514 based on time variation of the rotation phase θ.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-094151, filed on May 9, 2016, and Japanese Patent Application No. 2017-043068, filed on Mar. 7, 2017 which are hereby incorporated by reference herein in their entirety.

What is claimed is:

1. A sheet conveying apparatus comprising:

a stacking unit configured such that a sheet member is stacked thereon;

a feeding unit configured to feed a sheet member stacked on the stacking unit;

a conveying roller that is provided downstream of the feeding unit in a conveying direction in which the sheet member is conveyed, and that is configured to convey the sheet member fed by the feeding unit downstream in the conveying direction;

a motor configured to drive the conveying roller;

a phase determiner configured to determine a rotation phase of a rotor of the motor; and a controller configured to control a drive current flowing in a winding of the motor based on a value of a torque current component for generating torque on the rotor of the motor and a value of an excitation current component that influences an intensity of magnetic flux passing through the winding of the motor, the torque current component and the excitation current component being current components of the drive current flowing in the winding of the motor and being expressed in a rotating coordinate system that is based on the rotation phase determined by the phase determiner, wherein in a state in which the conveying roller is conveying a first sheet member that was fed by the feeding unit, if the value of the torque current component of the drive current flowing in the winding of the motor changes from a value greater than or equal to a predetermined value to a value less than the predetermined value, the feeding unit starts feeding of a second sheet member that is to be fed after the first sheet member.

2. The sheet conveying apparatus according to claim 1, wherein in a state in which the conveying roller is conveying the first sheet member, if the value of the torque current component of the drive current flowing in the winding of the motor changes from a value greater than or equal to the predetermined value to a value less than the predetermined value but not less than a second predetermined value which is greater than the predetermined value, and if the value of the torque current component continues to be greater than or equal to the predetermined value for a predetermined time, the feeding unit starts feeding of the second sheet member.

3. The sheet conveying apparatus according to claim 2, wherein the sheet conveying apparatus comprises a detector configured to detect the sheet member between the feeding unit and the conveying roller, and in a state in which the conveying roller is conveying the first sheet member, if a state where the value of the torque current component of the drive current flowing in the winding of the motor is less than the second predetermined value and greater than or equal to the predetermined value has continued for the predetermined time, and then the value of the torque current component changes to a value less than the predetermined value, and furthermore the detector has not detected a sheet member, the feeding unit starts feeding of the second sheet member.

4. The sheet conveying apparatus according to claim 2, wherein the feeding unit includes;

a pickup roller configured to feed a sheet member stacked on the stacking unit, a feeding roller configured to further feed the sheet member fed by the pickup roller, and a separation member configured to form a nip portion with the feeding roller and separate a plurality of sheet members conveyed in an overlapped state by the feeding roller in the nip portion, and the predetermined value is greater than a value of a second torque current component corresponding to a load torque applied to the rotor of the motor when the conveying roller conveys the first sheet member in a state in which the first sheet member is not nipped in the nip portion, and is less than a value of a third torque current component corresponding to a load torque applied to the rotor of the motor when the conveying roller conveys the first sheet member in a state where the first sheet member and the second sheet member are nipped in an overlapped manner in the nip portion.

5. The sheet conveying apparatus according to claim 4, wherein driving of the feeding roller is stopped when the conveying roller conveys the first sheet member, and the second predetermined value is less than a value of a fourth torque current component corresponding to a load torque applied to the rotor of the motor when the conveying roller conveys the first sheet member in a state in which the first sheet member is nipped and the second sheet member is not nipped in a nip portion between the separation member and the feeding roller in a stopped state, and greater than a value of the third torque current component.

6. The sheet conveying apparatus according to claim 5, wherein the separation member is a separation roller that forms the nip portion with the feeding roller, and the separation roller is configured to rotate by friction with the sheet member conveyed by the conveying roller in a period during which the sheet member conveyed by the conveying roller is nipped in the nip portion.

7. The sheet conveying apparatus according to claim 4, wherein driving of the feeding roller is synchronized with driving of the pickup roller.

8. The sheet conveying apparatus according to claim 1, further comprising:

a current detector configured to detect the drive current flowing in the winding of the motor; and a converter configured to convert a current value of the drive current detected by the current detector from a current value in a static coordinate system to a current value in the rotating coordinate system, based on a rotation phase determined by the phase determiner, wherein the feeding unit starts feeding of the second sheet member based on a torque current component of the current value in the rotating coordinate system converted by the converter.

9. A document reading apparatus comprising:

a stacking unit configured such that a document is stacked thereon;

a feeding unit configured to feed a document stacked on the stacking unit;

a conveying roller that is provided downstream of the feeding unit in a conveying direction in which the document is conveyed, and that is configured to convey the document fed by the feeding unit downstream in the conveying direction;

a reading unit configured to read the document conveyed by the conveying roller;

a motor configured to drive the conveying roller;

a phase determiner configured to determine a rotation phase of a rotor of the motor; and a controller configured to control a drive current flowing in a winding of the motor based on a value of a torque current component for generating torque on the rotor of the motor and a value of an excitation current component that influences an intensity of magnetic flux passing through the winding of the motor, the torque current component and the excitation current component being current components of the drive current flowing in the winding of the motor and being expressed in a rotating coordinate system that is based on the rotation phase determined by the phase determiner, wherein in a state in which the conveying roller is conveying a first document that was fed by the feeding unit, if the value of the torque current component of the drive current flowing in the winding of the motor changes from a value greater than or equal to a predetermined value to a value less than the predetermined value, the feeding unit starts feeding of a second document that is to be fed after the first document.

10. An image forming apparatus comprising:

a stacking unit configured such that a sheet member is stacked thereon;

a feeding unit configured to feed a sheet member stacked on the stacking unit;

a conveying roller that is provided downstream of the feeding unit in a conveying direction in which the sheet member is conveyed, and that is configured to convey the sheet member fed by the feeding unit downstream in the conveying direction;

an image forming unit configured to form an image on the sheet member conveyed by the conveying roller;

a motor configured to drive the conveying roller;

a phase determiner configured to determine a rotation phase of a rotor of the motor; and a controller configured to control a drive current flowing in a winding of the motor based on a value of a torque current component for generating torque on the rotor of the motor and a value of an excitation current component that influences an intensity of magnetic flux passing through the winding of the motor, the torque current component and the excitation current component being current components of the drive current flowing in the winding of the motor and being expressed in a rotating coordinate system that is based on the rotation phase determined by the phase determiner, wherein in a state in which the conveying roller is conveying a first sheet member that was fed by the feeding unit, if the value of the torque current component of the drive current flowing in the winding of the motor changes from a value greater than or equal to a predetermined value to a value less than the predetermined value, the feeding unit starts feeding of a second sheet member that is to be fed after the first sheet member.

11. A sheet conveying apparatus comprising:

a stacking unit configured such that a sheet member is stacked thereon;

a feeding unit configured to feed a sheet member stacked on the stacking unit;

a conveying roller that is provided downstream of the feeding unit in a conveying direction in which the sheet member is conveyed, and that is configured to convey the sheet member fed by the feeding unit downstream in the conveying direction;

a detector provided between the feeding unit and the conveying roller with respect to the conveying direction and configured to detect the sheet member;

a motor configured to drive the conveying roller; and a controller configured to control feeding of the sheet member by the feeding unit, wherein in a state in which the conveying roller is conveying a first sheet member that was fed by the feeding unit, if a load torque on a rotor of the motor changes from a torque greater than or equal to a first predetermined torque to a torque less than the first predetermined torque without continuing a state in which the load torque is less than a second predetermined torque and is greater than or equal to the first predetermined torque for a predetermined time, the controller controls the feeding unit to start feeding of a second sheet member that is to be fed after the first sheet member, the second predetermined torque being greater than the first predetermined value, and wherein in the state in which the conveying roller is conveying the first sheet member, if the state in which the load torque is less than the second predetermined torque and greater than or equal to the first predetermined torque has continued for the predetermined time, the controller controls the feeding of the second sheet member by the feeding unit based on a detected result of the detector.

12. The sheet conveying apparatus according to claim 11, further comprising:

a phase determiner configured to determine a rotation phase of the rotor, wherein the controller controls a drive current flowing in a winding of the motor so as to reduce a difference between an instructed phase indicating a target phase of the rotor and the rotation phase determined by the phase determiner, and wherein, in the state in which the conveying roller is conveying the first sheet member, if a value of the drive current corresponding to the load torque changes from a value greater than or equal to a first predetermined value corresponding to the first predetermined torque to a value less than the first predetermined value without continuing a state in which the value corresponding to the load torque is less than a second predetermined value and is greater than or equal to the first predetermined value, for the predetermined time, the controller controls the feeding unit to start feeding of the second sheet member, and wherein the controller controls, in the state in which the conveying roller is conveying the first sheet member, if the state in which the value corresponding to the load torque is less than the second predetermined value and greater than or equal to the first predetermined value has continued for the predetermined time, the controller controls the feeding of the second sheet member by the feeding unit based on the detected result of the detector.

13. The sheet conveying apparatus according to claim 11, wherein the feeding unit includes:

a pickup roller configured to feed the sheet member stacked on the stacking unit, a feeding roller configured to further feed the sheet member fed by the pickup roller, and a separation member configured to form a nip portion with the feeding roller and separate a plurality of sheet members conveyed in an overlapped state by the feeding roller in the nip portion.

14. The sheet conveying apparatus according to claim 13, wherein driving of the feeding roller is stopped when the conveying roller conveys the first sheet member.

15. The sheet conveying apparatus according to claim 13, wherein the separation member is a separation roller that forms the nip portion with the feeding roller, and the separation roller is configured to rotate by friction with the sheet member conveyed by the conveying roller in a period during which the sheet member conveyed by the conveying roller is nipped in the nip portion.

16. The sheet conveying apparatus according to claim 13, wherein driving of the feeding roller is synchronized with driving of the pickup roller.

17. The sheet conveying apparatus according to claim 11, wherein in the state in which the conveying roller is conveying the first sheet member, if the state in which the load torque is less than the second predetermined torque and greater than or equal to the first predetermined torque has continued for the predetermined time, and then the load torque changes to a value less than the first predetermined value, and the detector has not detected the first sheet member, the controller controls the feeding unit to start feeding of the second sheet member.

18. A document reading apparatus comprising:

a stacking unit configured such that a document is stacked thereon;

a feeding unit configured to feed a document stacked on the stacking unit;

a conveying roller that is provided downstream of the feeding unit in a conveying direction in which the document is conveyed, and that is configured to convey the document fed by the feeding unit downstream in the conveying direction;

a reading unit configured to read the document conveyed by the conveying roller;

a detector provided between the feeding unit and the conveying roller with respect to the conveying direction and configured to detect the document a motor configured to drive the conveying roller; and a controller configured to control feeding of the document by the feeding unit, wherein in a state in which the conveying roller is conveying a first document that was fed by the feeding unit, if a load torque on a rotor of the motor changes from a torque greater than or equal to a first predetermined torque to a torque less than the first predetermined torque without continuing a state in which the load torque is less than a second predetermined torque and is greater than or equal to the first predetermined torque for a predetermined time, the controller controls the feeding unit to start feeding of a second document that is to be fed after the first document, the second predetermined torque being greater than the first predetermined value, and wherein in the state in which the conveying roller is conveying the first document, if the state in which the load torque is less than the second predetermined torque and greater than or equal to the first predetermined torque has continued for the predetermined time, the controller controls the feeding of the second document by the feeding unit based on a detected result of the detector.

19. An image forming apparatus comprising:

a stacking unit configured such that a sheet member is stacked thereon;

a feeding unit configured to feed a sheet member stacked on the stacking unit;

a conveying roller that is provided downstream of the feeding unit in a conveying direction in which the sheet member is conveyed, and that is configured to convey the sheet member fed by the feeding unit downstream in the conveying direction;

an image forming unit configured to form an image on the sheet member conveyed by the conveying roller;

a detector provided between the feeding unit and the conveying roller with respect to the conveying direction and configured to detect the sheet member;

a motor configured to drive the conveying roller; and a controller configured to control feeding of the sheet member by the feeding unit, wherein in a state in which the conveying roller is conveying a first sheet member that was fed by the feeding unit, if a load torque on a rotor of the motor changes from a torque greater than or equal to a first predetermined torque to a torque less than the first predetermined torque without continuing a state in which the load torque is less than a second predetermined torque and is greater than or equal to the first predetermined torque for a predetermined time, the controller controls the feeding unit to start feeding of a second sheet member that is to be fed after the first sheet member, the second predetermined torque being greater than the first predetermined value, and wherein in the state in which the conveying roller is conveying the first sheet member, if the state in which the load torque is less than the second predetermined torque and greater than or equal to the first predetermined torque has continued for the predetermined time, the controller controls the feeding of the second sheet member by the feeding unit based on a detected result of the detector.

20. A sheet conveying apparatus comprising:

a stacking unit configured such that a sheet member is stacked thereon;

a feeding unit configured to feed a sheet member stacked on the stacking unit;

a conveying roller that is provided downstream of the feeding unit in a conveying direction in which the sheet member is conveyed, and that is configured to convey the sheet member fed by the feeding unit downstream in the conveying direction;

a motor configured to drive the conveying roller;

a phase determiner configured to determine a rotation phase of a rotor of the motor; and a controller configured to control a drive current flowing in a winding of the motor so that a difference between an instructed phase indicating a target phase of the rotor and the rotation phase determined by the phase determiner is reduced, wherein, in a state in which the conveying roller is conveying a first sheet member that was fed by the feeding unit, if a value based on the difference changes from a value greater than or equal to a predetermined value to a value less than the predetermined value, the controller controls the feeding unit to start feeding of a second sheet member that is to be fed after the first sheet member, and the value based on the difference corresponds to a torque on the rotor.

21. A sheet conveying apparatus comprising:

a stacking unit configured such that a sheet member is stacked thereon;

a feeding unit configured to feed a sheet member stacked on the stacking unit;

a conveying roller that is provided downstream of the feeding unit in a conveying direction in which the sheet member is conveyed, and that is configured to convey the sheet member fed by the feeding unit downstream in the conveying direction;

a motor configured to drive the conveying roller;

a speed determiner configured to determine a rotation speed of a rotor of the motor; and a controller configured to control a drive current flowing in a winding of the motor so that a difference between an instructed speed indicating a target speed of the rotor and the rotation speed determined by the speed determiner is reduced, wherein, in a state in which the conveying roller is conveying a first sheet member that was fed by the feeding unit, if a value based on the difference changes from a value greater than or equal to a predetermined value to a value less than the predetermined value, the controller controls the feeding unit to start feeding of a second sheet member that is to be fed after the first sheet member, and the value based on the difference corresponds to a torque on the rotor.

* * * * *